United States Patent [19]

Siegal et al.

[11] Patent Number: 4,708,260

[45] Date of Patent: Nov. 24, 1987

[54] HYDRAULIC COUPLING COMPRISING A SEALED CLOSURE AND CONNECTION FITTING FOR A FLEXIBLE CONTAINER

[75] Inventors: Burton L. Siegal, Skokie; Daniel J. Leshuk, Park Ridge, both of Ill.

[73] Assignee: Kiwi Coders Corporation, Wheeling, Ill.

[21] Appl. No.: 835,101

[22] Filed: Feb. 28, 1986

Related U.S. Application Data

[63] Continuation of Ser. No. 664,977, Oct. 26, 1984, abandoned.

[51] Int. Cl.[4] ..... A47C 27/08

[52] U.S. Cl. ..... 220/465; 220/256; 222/542; 222/562; 222/563

[58] Field of Search ..... 220/465, 254, 256, 281, 220/85 F, 85 SP, DIG. 19; 222/562, 563, 566, 572, 570, 569, 542

[56] References Cited

U.S. PATENT DOCUMENTS

| | | | |
|---|---|---|---|
| 1,635,122 | 7/1927 | Henriques | 220/256 |
| 2,687,831 | 8/1954 | Miller | 222/569 |
| 2,861,709 | 11/1958 | Goll | 220/256 |
| 2,969,161 | 1/1961 | McCulloch | 220/258 X |
| 3,101,878 | 8/1963 | Bee | 222/542 |
| 3,124,281 | 3/1964 | Stull | 222/542 |
| 3,404,816 | 10/1968 | Weber | 222/562 X |
| 3,542,240 | 11/1970 | Solowey | 220/256 X |
| 3,926,348 | 12/1975 | Lutzker | 222/563 X |
| 4,152,378 | 5/1979 | Vcelka et al. | 220/258 X |
| 4,470,164 | 9/1984 | Soderstrom et al. | 222/563 X |

*Primary Examiner*—Steven M. Pollard

*Attorney, Agent, or Firm*—Silverman, Cass, Singer and Winburn, Ltd.

[57] ABSTRACT

A hydraulic coupling for a "Bag-in-the-box" fluid container, comprising a sealed closure and a connection fitting sealably engaged therewith, the closure including a hollow tube carrying a tapered, dislodgable plug and the connection fittig for coupling to a hydraulic pick-up line, the fitting sealably engaged in the tube and having a plunger arranged to dislodge the plug to gain access to the content of the gab for transmission of the content of the bag to the pick-up line.

25 Claims, 8 Drawing Figures

FIG. 1
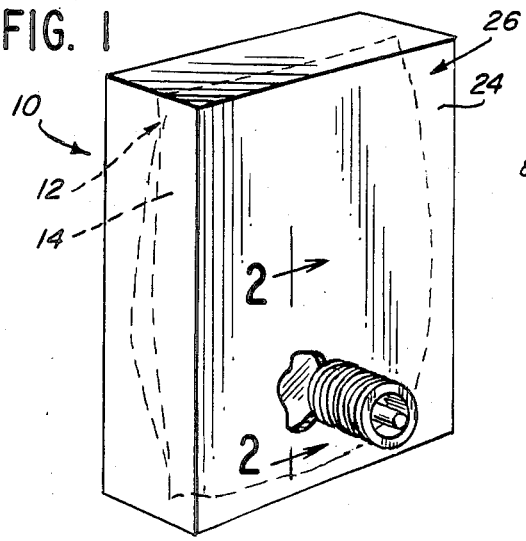
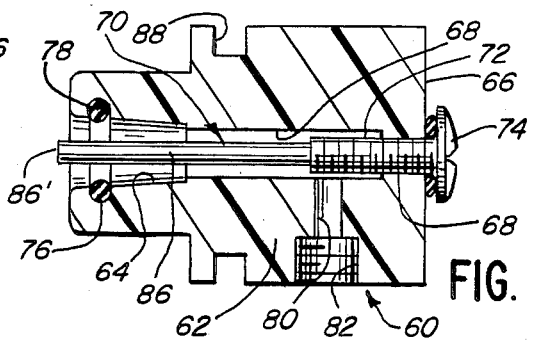
FIG. 3
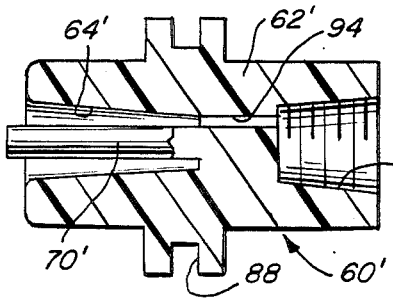
FIG. 4
FIG. 5
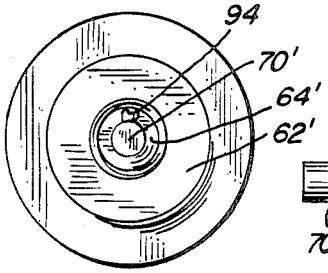
FIG. 2
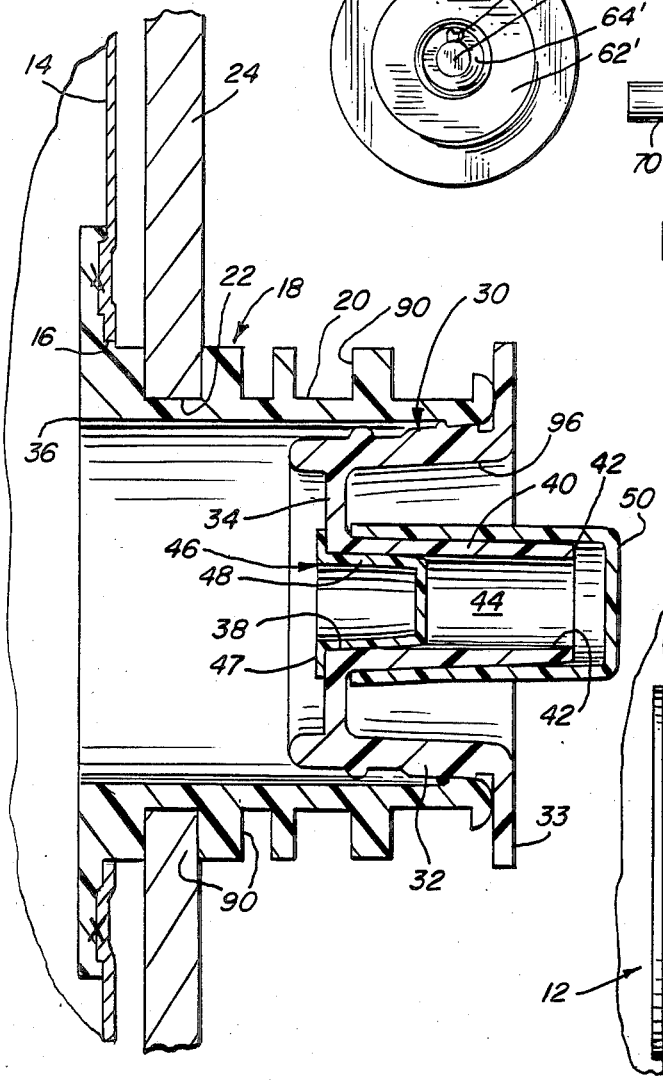
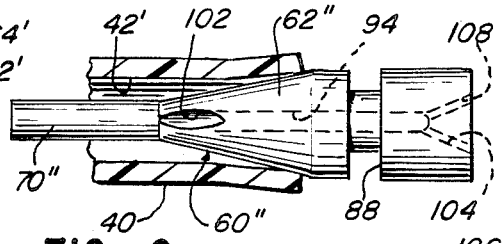
FIG. 6
FIG. 7
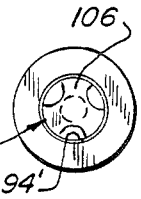
FIG. 8
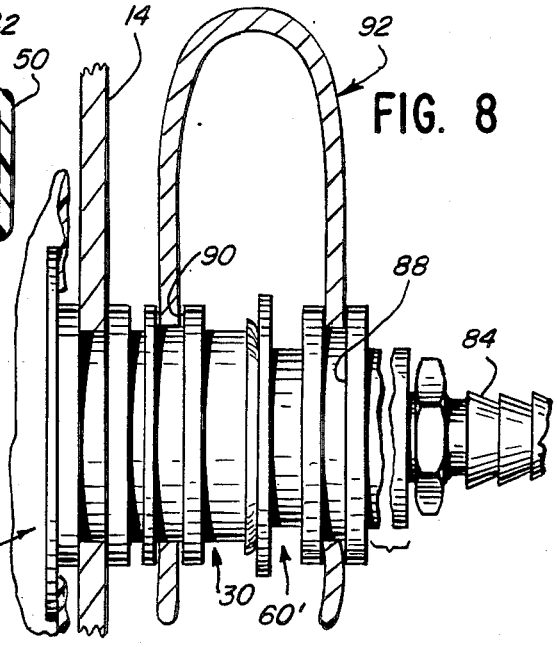

HYDRAULIC COUPLING COMPRISING A SEALED CLOSURE AND CONNECTION FITTING FOR A FLEXIBLE CONTAINER

This is a continuation of application Ser. No. 664,977 filed Oct. 26, 1984, abandoned.

BACKGROUND OF THE INVENTION:

This invention relates generally to so-called bag-in-the-box containers for flowable materials such as liquids, powders and the like and more particularly, concerns the provision of an improved closure plug and a connector fitting adapted to be coupled thereto, said closure plug having internal dislodgeable means blocking access to the contents of the container, but offering access when dislodged from the exterior of the container.

Packaging of flowable materials such as liquids, powders and the like for direct dispensing thereof offers many difficulties, particularly if the materials are valuable, odiferous, corrosive or possessed of other noxious or disagreeable characteristics. Further, it often is desired that the container for such materials not only must be sealed but must be capable of being completely emptied of its contents, i.e., dispensed to the last drop. In many applications, throwaway packages are preferred to reduce waste and to obviate disposal problems in storing and disposal of containers of the rigid or semi-rigid catagory.

The development of the so-called bag-in-the-box packaging concepts have met with considerable success in providing solutions to the above dispensing packaging difficulties. The bag-in-the box concepts involve the packaging of the flowable materials in flexible bags which themselves are disposed within corrugated paperboard containers for dispensing of the contents. These filled bags generally take the shape of the paperboard container within which they are disposed and are supported therein by the walls thereof. Means are provided for establishing access to the inner container which, when filled, often expands to conform to the interior of the outer container for use in desired automatic dispensing machines.

Use of such containers also enables reduction in both bulk and weight, as well as affords the convenience of maximum space utilization for shipping since the flowable material conforms to the shape of the container, the container being impervious to the material packaged therein and the overall shape of the box and container being suitable for efficient storage and loading as for shipping in commerce. Avoidance of rigid containers such as formed of steel, glass or plastic offers material reduction in shipping weight as well as the benefits involved in disposal of such container. Possible contamination of the flowable material contents likewise is a logistical problem. Opening of such containers is difficult. The bag-in-the-box packaging generally reduces the need for providing special access means. Acceptance of such technique is popular because it enables dispensing without retention of much residual material in the container. Lightweight corrugated paper containers may be employed.

The aforementioned bag-in-a-box containers have found wide acceptance in the packaging of flowable powders, corrosive liquids, printing inks, dyes, milk, etc.

Often where flowable material such as ink, dyes, corrosive liquids and the like are packaged for dispensing from the container, greater security against leakage during transit, handling and coupling to the dispensing system must be afforded to assure that the flowable material does not escape from the package and/or the connection to the system. In addition to the safety requirements in the handling and dispensing of the flowable material, improved provision for security should be afforded but without significant increase in cost.

SUMMARY OF THE INVENTION

The invention provides a closure plug and flow fitting for the flexible bag of a bag-in-the-box type container used for the packaging of flowable materials such as liquids, powders and the like, the closure plug being sealingly coupled to the filling spout of such flexible bag. The closure plug has a cylindrical multi-flanged tubular body, an annular exterior flange at one end thereof, a transverse interior disc formation at the opposite end of the body, the disc having a central opening and an elongate hollow tube formed unitary with said disc about the central opening and extending concentrically toward the flanged end of the body. The hollow tube is plugged at its inner end with a dislodgeable sealing plug. The exterior end of the tube is capped by a sealing cap. Further, a connecting or tapping fitting is provided adapted to be coupled sealably to the closure plug for connecting the hollow tube thereof to the dispensing system. In one embodiment, the connecting or tapping fitting includes a tapered recess having a cental plunger arranged for dislodging the inner plug, said plunger capable of being moved reciprocably in and out of the recess to effect such dislodgement. Once the fitting has been secured to the closure, the inner plug can be dislodged by manipulating the plunger with using suitable screw means provided. Sealing means may be provided interior of the tapered passageway of the connector fitting. The sealing connection can be effected both by coupling the fitting via the interior or the exterior surface of the hollow tube of the closure. The discharge portion of the fitting may be coaxial, may be offset or may be eccentric relative to the longitudinal axis thereof. The tube portion of the closure plug may be tapered a narrow diameter exterior portion with the dislodgeable plug of like taper. It is important to recognize that the inner plug is self sealing, that is the higher the internal pressure of the flexible container, the greater the sealing force exercised on the plug, the flange provided on the plug serving as a stop therefor.

BRIEF DESCRIPTION OF THE DRAWINGS

FIG. 1 is a partially exploded perspective view of a package comprising a flexible bag seated within a corrugated paperboard box with a flanged filling spout secured to the wall of the bag and passing through a wall of the box, the sealing plug of the invention being secured thereon and illustrated on one side for ease in viewing.

FIG. 2 is an enlarged sectional view of the flanged filling spout with the sealing plug according to the invention installed therein;

FIG. 3 is a longitudinal sectional view of a connector fitting for coupling the package to a dispensing system;

FIG. 4 is a view similar to FIG. 3 but illustrating a modified connector fitting;

FIG. 5 is an end view of the fitting illustrated in FIG. 4;

FIG. 6 is a fragmentary longitudinal section illustrating a further modification of the connector fitting;

FIG. 7 is an enlarged end view of the fitting illustrated in FIG. 6, and,

FIG. 8 is a diagrammatic sectional view of the installed filling spout closure plug and connector fitting illustrating a security spring lock installed thereon.

DESCRIPTION OF PREFERRED EMBODIMENTS

The invention to be described herein comprises a closure plug and a connector fitting for use on a flexible dispensing container, i.e., a bag seated within a box normally formed of corrugated paperboard, for the packaging therein of flowable materials such as liquids (ink, dyes, corrosive material) and powders. The closure plug is snap-fitted or otherwise tightly coupled to the flanged filling spout which is sealed to a wall of the flexible bag and is commonly passed through a wall of the box. The connector fitting is adapted to be coupled to the closure plug and is provided with means for gaining access to the interior of the bag via the closure plug. The fitting also is provided with means for coupling a conduit thereto for directing the flow of the material to a predetermined destination.

The closure plug includes a flanged cylindrical hollow body having a transverse wall interior thereof adjacent one end of the body. An opening is formed in said transverse wall and an interior, tapered discharge tube is integral with said wall and surrounds said opening, extending generally parallel to the axis of the body toward the opposite end of the body. A plastic sealing plug is provided at the inner end of the discharge tube and a cap preferably is secured over the narrower outer end of the discharge tube. The discharge tube need not be tapered but the sealing plug must be of a configuration tightly to be received therein.

The connector fitting is provided with means for sealingly accommodating the tapered discharge tube of the closure cap. Exterior means also are provided for gaining access to the interior of the flexible container by selective dislodgement of the inner plug from the inner end of the tapered discharge tube. Means are provided for coupling a conduit to the fitting to direct the flowing material to a destination, say a dispensing system or the like.

Referring to FIG. 1, a typical bag-in-a-box container 10 is illustrated as comprising a flexible bag 12 formed by hermetically sealing the edges of a pair of superposed sheets of metallized plastic and liner. One wall 14 of bag 12 has an access opening 16 and carries a flanged spout 18 sealed thereto surrounding the opening 16. The flanged spout 18 includes an outwardly extending multiflanged tubular portion 20 which is adapted to be pulled through a suitable passage 22 formed in wall 24 of the box 26 which preferably is formed of corrugated paperboard material. The spout 18 is closed by force fitting, as by a snap-in connection, of the closure plug 30.

The closure plug 30 has an externally ribbed cylindrical tubular body 32 with an annular flange 33 at one end and a transverse wall 34 at its opposite end 36. A unitary transverse wall 34 includes a central opening 38 and an elongate hollow discharge tube 40 is formed as a unitary part of said wall 34 surrounding the opening 38 and extending interior of the body 32 generally concentric with and parallel to the axis thereof. The tube 40 is tapered in a direction so that the narrow portion is located at the delivery or outer end 42 of the discharge tube 40. The chamber 44 interior of the tube 40 is likewise tapered to place the narrow opening 42' adjacent the opening of body 32. A sealing plug 46, preferably tapered, is seated tightly in the entrance 48 of the chamber 44 while a cap 50 is force-fitted over the delivery end 42 of discharge tube 40. The sealing cap 50 is slightly tapered to conform to the configuration of the discharge tube 40 at its end 42 so that it sealably receives said tapered delivery end 42. An additional function of the cap 50 is to prevent dirt or other foreign material from entering the chamber 44 from the exterior of the plug 30.

The cap 50 also serves to protect against the unauthorized use of a foreign object to gain access to the internal plug 46 for the purpose of dislodging same and tapping into the content of the bag 12. The tapered fit between the discharge tube 40 and the internal plug 46 achieves a tight effectively self-sealing engagement against increased pressure due to sudden surges resulting from handling and impact during manipulation of the package or from a pressure build-up interior of the flexible bag 12 occuring when the same is placed under adverse pressure and/or environmental conditions. The flange 47 on plug 46 serves as a stop limit to prevent its its being forced through the interior 44 of tube 40 by excess pressure interior of the bag 12.

The closure plug 30 assembled with the plug 46 and cap 50 is coupled to the flexible bag 12 by effecting a force-fit within the spout 18 after the bag 12 is filled with the flowable material and the flange 33 abuts tightly against the spout 18. The plug 30 can rest against the interior of wall 24 of exterior box 26. The package 10 now is suitable for shipping and storage. A punch-out wall portion (not shown) can be provided and the spout 18 pulled through same.

For use, a tapping connector or fitting is provided. Referring to FIG. 3, there is illustrated tapping connector fitting 60 provided by the invention herein and adapted to be coupled sealably to the closure plug 30 for gaining access to the contents of the bag 12 and directing such contents to a predetermined location, say removed from the package. The tapping connector or fitting 60 comprises a body 62 having an interior conical chamber 64 conforming generally to the configuration of the tapered discharge tube 40 and extending toward the opposite end 66 of the body 62. A threaded passage 68 is formed in body 62 opening to the opposite end 66 of the body 62 and carries suitable threading for reception therethrough of plunger 70 having an enlarged threaded inner end 72 having an enlarged head 74. Resilient sealing ring 76 is seated in groove 78 formed adjacent the entrance to chamber 64. A radial passage 80 is formed in body 62 to communicate with the interior of the internal passageway 68 and opens to threaded socket 82 capable of receiving a threaded male coupling 84. The plunger 70 comprises a cylindrical rod 86 which is disposed coaxially within the chamber 64 and passageway 68 and extends outward of the entrance to conical chamber 64. The inner diameter of the sealing ring 76 is selected to be slightly less than the greater diameter of the tapered discharge tube 40 of the closure plug 30. When the connector fitting 60 and plug 30 are assembled by removing the cap 50 and force-fitting tube 40 into the tapered chamber 64, the O-ring 76 is sealingly engaged against the outer wall of said discharge tube 40. The The plunger 70 is received within the tube 40 and the end 86' of rod 86 forced against the plug 48 to dislodge same, thereby gaining access to the flowable material within the flexible bag 12. The outer diameter of the body 62 coextensive with the chamber 64 is selected to be slightly less than the inner diameter of the body 32 and closure plug 30.

FIG. 4 illustrates a modified fitting 60' wherein the plunger 70' is integral with the fitting body 62' and the threaded socket 68' is formed concentric with the chamber 64'. Fitting 62' has a relatively short, axial passageway 94 therein eccentric relative to the central axis of the conical chamber 64' in fitting body 62' as an extension thereof communicating to the socket 68'. The plunger 70' is formed integral with the fitting body 62' and extends at its free end a predetermined distance outward of the entrance to chamber 64'. The body 62' is forced into the well 96 defined between the tube 40 and the inner wall of body 32 of the closure 30. When the body 62' is seated on said tube 40, the plunger 70' has forced the plug 46 from the entrance to chamber 44 of tube 40. The discharge of the contents of the bag 12 is effected through the concentric opening 68'. The flow from the discharge tube 40 is by way of the short, axial passageway 94. The internal O-ring 76 of fitting 60 is not required. The relationship of the passageways is illustrated in FIG. 5.

FIG. 6 illustrates another modified connector fitting, here represented by fitting 60''. Fitting 60'' differs from fittings 60 and 60' in that the body 62'' of fitting 60'' has an outer tapered portion, with the plunger 70'' being unitary with the narrow end of the body 62''. Axial openings 102 are formed in the body 62'' adjacent the junction of plunger 70'' therewith, said one or more openings 102 extend as internal coaxial passageways 94'. The passageways 94' terminate in rearwardly opening threaded socket 104. There is inserted a plug 105 having symmetrically arranged ribs or flutes 106. Axial passageways 94' are defined between the resultant ribs or flutes 106 and are eccentric relative to the center of the fitting 60''.

In FIG. 9 there is illustrated the safety locking clip 92 installed positively to resist vibrational and other axial forces tending to separate the respective fittings from their engagement with the closure plug 30. An annular groove or grooves 88 is provided in the portion of the body 62 which is exterior of the closure plug 30 when the fitting is fully engaged therein. The groove or grooves 88 cooperate with grooves 90 formed in exterior of the spout 18 to enable U-shaped safety clip 92 to be seated in one of said outer selected grooves 90 and the annular groove 88 formed in the fitting body 60 positively for effecting a positive locking engagement. Clip 92 may be formed as a spring clip. Other retaining means can be applied to maintain the engagement of fitting 60 and closure plug 30 and spout 18. The circumferential surfaces of all the fitting bodies of the fittings which are illustrated herein are provided with the aforementioned outer rings or grooves 88 or their equivalent. The rings formed in the spout members serve to engage the wall 14 about a circular opening formed in the wall of said outer container 16 through which the flanged spout member 18 is pulled when seating same.

This engagement maintains the position of the filling flanged spout member and facilitates the use of the container. The safety lock is shown as a U-shaped spring element, either formed as a metal stamping or a wire form that is radially engaged, a groove 80 in the fitting 60 and one of the grooves 90 on the flanged spout 18 which may be available. When applied, relative motion between said spout and fitting 60 is materially resisted. When the safety lock element is formed of spring metal, the cantilever spring action provided exerts a positive clamping force therebetween. The wire form, for example, can even be made captive on one of the grooves of the fitting 60 with the free portion thereat capable of being secured onto the spout and anchored into a suitable groove 90 formed thereon.

The bag-in-a-box 10 is illustrated oriented on one side but in use, preferably is disposed in a canted rack (not shown) with the spout 18 facing downward, wall 24 functioning as the bottom wall, so that container 12 can be substantially fully emptied of its content.

Variations are capable of being made without departing from the spirit or scope of the invention as defined in the attached claims.

What is desired to secure by Letters Patent of the United States is:

1. A make before break hydraulic coupling for a flexible container of the type having an outwardly directed tubular spout capable of storing a flowable material and comprising, in combination, a sealed closure secured to the spout and a connection fitting coupled to the closure, said fitting having means for connecting same to a hydraulic pick-up line, said sealed closure comprising a unitary generally cylindrical tubular body conforming in configuration to the spout and having opposite ends, said body having an annular flange at one end engageable with the spout and a transsverse interior wall, said transverse wall having a through passage and an elongate tube disposed within the body unitary with the transverse wall, surrounding said passage and extending parallel to the axis of said body, said tube having an inlet opening to said passage and an outlet opposite the inlet, an inwardly displacable tapered plug sealably seated within the inlet of the tube closing off said passage, said plug capable of being forced into the inlet under the fluid pressure originating interior of the container, said connector fitting being coupled to the body and including means for establishing a sealed connection with the tube with the outlet, said fitting further including a plunger engagable with said plug when said fitting is sealably engaged with said tube at said outlet and capable of dislodging the plug axially inwardly from the inlet enabling transmission of the content of the container to the hydraulic pick-up line and said fitting including means for manipulating said plunger generally axially to effect said dislodgement.

2. The hydraulic coupling according to claim 1 in which said plunger is of a length and configuration sufficient to dislodge said plug during engagement of the connector fitting to the sealed closure.

3. The hydraulic coupling according to claim 1 in which th plunger is movable along a short axial path sufficient to effect dislodgement of the plug.

4. The hydraulic coupling as claimed in claim 1 in which the connection fitting has an end opening socket conforming to the configuration of the outlet end of the tube for receiving same.

5. The hydraulic coupling according to claim 4 and means in the end opening socket for establishing a sealed connection with said tube.

6. The hydraulic coupling according to claim 4 and a second socket formed in the fitting communicating with the outlet from the end opening socket and enabling coupling of a conduit thereto, the conduit leading to the pick-up line.

7. The hydraulic coupling according to claim 6 and the second socket being formed in the fitting offset from the end opening socket.

8. The hydraulic coupling according to claim 6 and a radial socket formed in the fitting offset from the end opening socket enabling coupling of the conduit thereto.

9. The hydraulic coupling according to claim 6 and an interior passage is formed in said connection fitting communicating between the end opening socket and a threaded socket and a conduit capable of being coupled to the threaded socket and leading to the pick-up line.

10. The hydraulic coupling according to claim 4 in which the connection fitting includes an interior passage and a second socket communicating therewith, coaxial with both said end opening socket and said interior passage, said plunger being integral with said body, said interior passage being eccentric relative to the axis of the end opening socket.

11. The hydraulic coupling according to claim 10 in which there is a fluted passageway and means coupled to the interior of said fitting leading coaxially to the exterior thereof.

12. The hydraulic coupling according to claim 1 in which said fitting has a generally conical portion, said plunger being integral with said conical portion and an axial through passage is formed in said conical portion, a conical chamber being formed within the fitting and communicating with said axial passage.

13. The hydraulic coupling according to claim 12 in which there are axial circumferentially spaced flute means in the last mentioned conical chamber.

14. The hydraulic coupling according to claim 13 in which said flute menas are formed symmetrical about the axis of said conical chamber.

15. The hydraulic coupling according to claim 1 in which said tube is tapered inwardly from the inlet and the plug has a flanged closed end engaging the transverse wall when the plug is engaged fully within said tube inlet.

16. The hydraulic coupling according to claim 1 wherein the plug has a taper greater in degree than the taper of the tube within the inlet.

17. The hydraulic coupling according to claim 1 wherein the plug has an annular lip engagable with the tranverse wall to prevent the plug from being forced entirely through the tube under the interior fluid pressure within the container.

18. The hydraulic coupling according to claim 1 in which the plug is tapered to a degree that its engagement within the tube is sufficient to be self-sealing with the interior wall of the tube under increase in the pressure within the container.

19. The hydraulic coupling according to claim 1 in which the flexible container is seated within an exterior package of relatively rigid material, the spout passing through a wall of said exterior package and being attached thereto, the closure seated within the spout and means for releasably locking the spout and connection fitting together with the closure sandwiched therebetween.

20. The hydraulic coupling according to claim 19 in which said releasable locking means comprises annular rings on both spout and fitting and clip means seatable across same and securing said spout and fitting together.

21. The hydraulic coupling according to claim 20 in which said clip means comprise a resilient return bent U-shaped spring clip.

22. The hydraulic coupling according to claim 1 in which the tube is coaxial with the plug.

23. The hydraulic coupling according to claim 1 in which the closure body has at least one exterior annular flange between the ends thereof.

24. The hydraulic coupling according to claim 1 and a removable protector cap securable on the tube closing off the outlet prior to attachment of the connector fitting and being removable so as to permit coupling of the fitting to said tube, said cap being removable prior to dislodgement of the plug.

25. The hydraulic coupling according to claim 1 in which said plug has a cup-like configuration.

* * * * *